United States Patent [19]

Oliver

[11] Patent Number: 4,671,444

[45] Date of Patent: Jun. 9, 1987

[54] STAPLER WITH IMPROVED JAM CLEARING MECHANISM

[75] Inventor: Daniel A. Oliver, East Greenwich, R.I.

[73] Assignee: Textron Inc., Providence, R.I.

[21] Appl. No.: 730,576

[22] Filed: May 6, 1985

[51] Int. Cl.[4] ..... B27F 7/06

[52] U.S. Cl. ..... 227/123; 227/88; 227/108

[58] Field of Search ..... 227/123, 108, 88, 87, 227/86, 89

[56] References Cited

U.S. PATENT DOCUMENTS

| | | | |
|---|---|---|---|
| 2,703,402 | 3/1955 | Forrester | 206/338 |
| 2,928,094 | 3/1960 | Crooks et al. | 227/86 |
| 2,938,212 | 5/1960 | Lerner | 227/86 |
| 2,943,436 | 7/1960 | Peterssen | 59/77 |
| 2,959,786 | 11/1960 | Peterssen | 227/86 X |
| 2,987,725 | 6/1961 | Heilman | 227/108 X |
| 3,009,156 | 11/1961 | Lerner | 227/88 |
| 3,029,436 | 4/1962 | Kufel, Jr. et al. | 227/108 X |
| 3,224,657 | 12/1965 | Zike | 227/108 X |
| 3,335,856 | 8/1967 | Libby | 206/56 |
| 3,504,837 | 4/1970 | Cairatti | 227/108 |
| 4,184,622 | 1/1980 | Spehrley, Jr. | 227/123 |

*Primary Examiner*—James F. Coan

*Attorney, Agent, or Firm*—Cushman, Darby & Cushman

[57] ABSTRACT

A stapler device of the type including an anvil for forming elongated preforms into U-shaped staples and a spring pressed feeder for engaging the legs of the formed staple to advance the supply. The device includes a mounting for the anvil, the feeder and the feeder spring as a self-contained assembly on the stapler housing for movement from an operative position in a lateral direction away from the drive track into a staple clearing position and from the staple clearing position in a lateral direction toward the drive track into the operative position. A manually operable assembly is provided for effecting movement of the anvil, the feeder and the feeder spring from the operating position into the staple clearing position.

6 Claims, 17 Drawing Figures

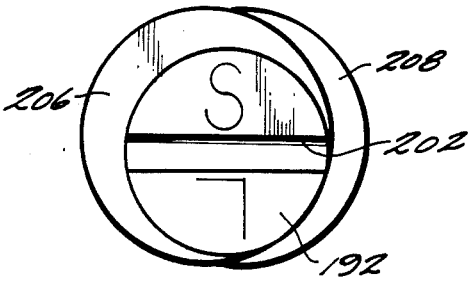
Fig. 7
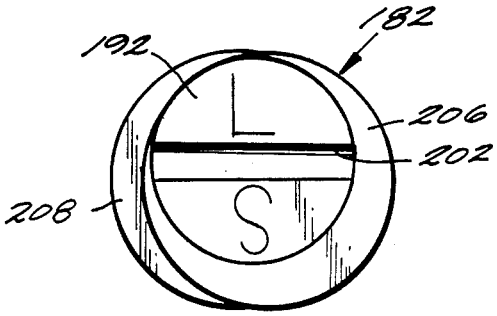
Fig. 8
Fig. 9
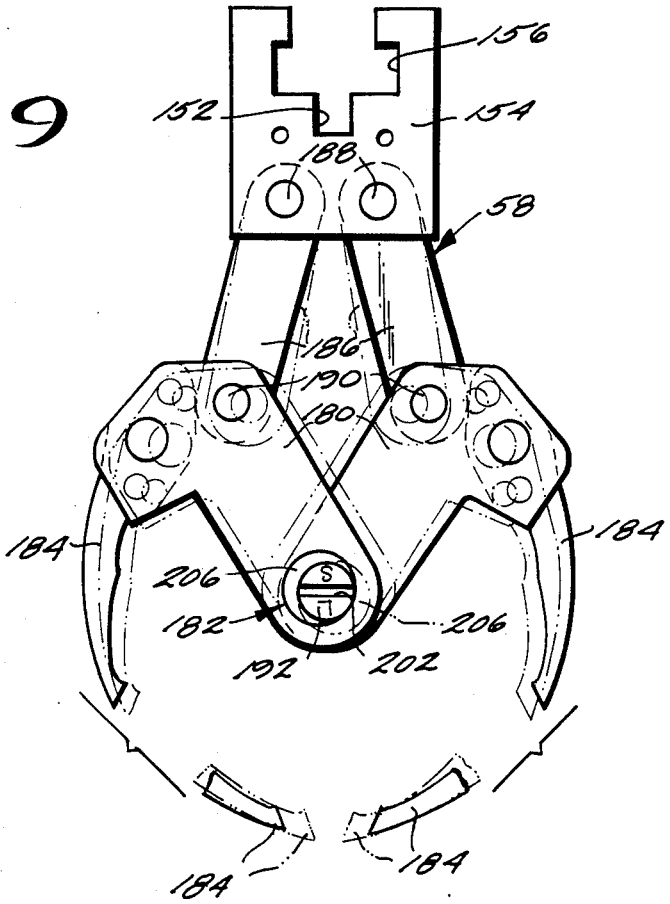

STAPLER WITH IMPROVED JAM CLEARING MECHANISM

This invention relates to fastener driving devices and more particularly to fastener driving devices of the type capable of handling staples in a supply formed of elongated preforms interconnected in side-by-side relation and rolled up into a coil.

Examples of the type of staple supply herein contemplated are disclosed in U.S. Pat. Nos. 2,703,402, 2,943,436, and 3,335,856. Examples of fastener driving devices capable of handling such staple supplies include U.S. Pat. Nos. 2,938,212, 2,959,786, 2,987,725, 3,009,156 and 3,029,436. In all of the last mentioned patents, the arrangement for handling the staple supply includes means for retaining the supply roll in a condition suitable to enable a leading end portion thereof to be paid out from the roll, means for forming a leading elongated preform staple into a U-shaped staple formation, means for feeding the leading U-shaped staple into the drive track and to advance with it the remaining staple preforms constituting the leading end portion of the roll and means for driving the U-shaped staple in the drive track outwardly into a workpiece. In some of the prior art arrangements, the U-shaped staple fed to the drive track is simply driven into the workpiece rather than being driven through the workpiece and clinched with respect thereto. Where the arrangement further provides for blind clinching the driven staple into the workpiece, the total combination of functional staple handling elements becomes considerably complex. In such arrangements, malfunctioning of the staple handling functional elements can more readily result in a staple jam in the drive track.

It is an object of the present invention to provide an improved means in arrangements of the type described for alleviating staple jams. In accordance with the principles of the present invention this objective is obtained by providing for the mounting of the anvil, the feeder and the feeder spring as a self-contained assembly on the stapler housing for movement from an operative position in a lateral direction away from the drive track into a staple clearing position and from the staple clearing position in a lateral direction toward the drive track into the operative position and a manually operable assembly for effecting movement of the anvil, the feeder and the feeder spring from the operating position into the staple clearing position.

Another object of the present invention is the provision of a stapling device having an arrangement of the type described provided with a staple clearing function which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

In the drawings:

FIG. 7 is an enlarged front elevational view of the adjustable pivot member for the clincher arms of the blind clincher mechanism showing the same in the position assumed to accomodate staples having legs of a relatively short dimension;

FIG. 8 is a view similar to FIG. 7 showing the adjustable pivot member in the position assumed when accomodating staples having legs of relatively long dimension;

FIG. 9 is a somewhat schematic view of the blind clincher mechanism showing the position of the parts in solid lines when the adjustable pivot member is in the position shown in FIG. 7 and in phantom lines when the adjustable pivot member is in the position shown in FIG. 8;

Figure 1:
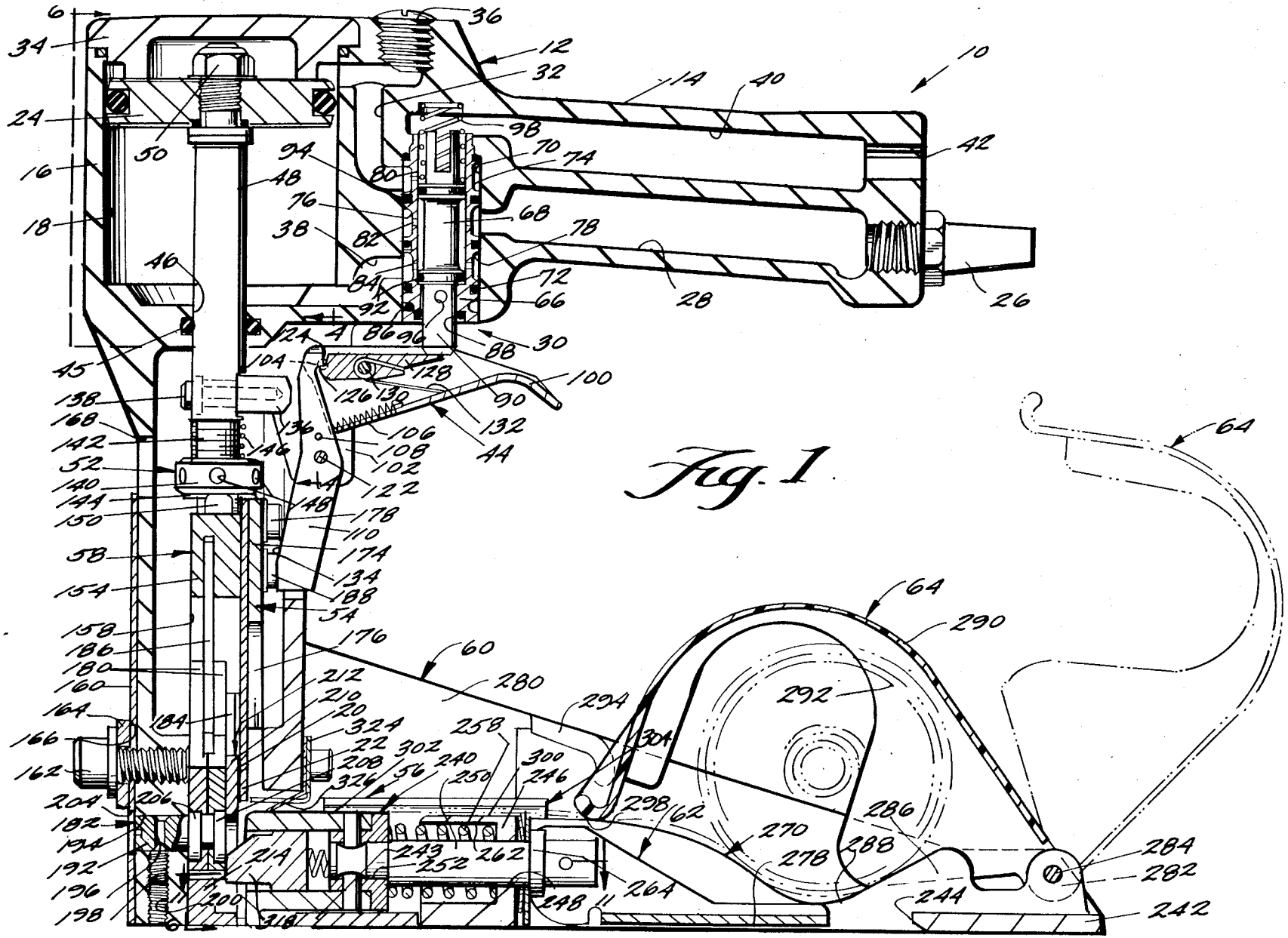
FIG. 1 is a vertical sectional view of a fastener driving device embodying the principles of the present invention showing the same in solid lines with the parts in the position they assume prior to the operation of the device to drive a staple, the staple preform roll cover being shown in its open access position in phantom lines.

Referring now more particularly to the drawings, there is shown in FIG. 1 a vertical sectional view of a fastener driving device, generally indicated at 10, which embodies the principles of the present invention. As shown, the device is a pneumatically actuated portable type device capable of driving staples and blind clinching the same into work pieces, such as carton flaps and the like, the staples being carried as a supply within the device in the form of elongated preformed staples interconnected together in parallel relation and formed into a roll. The device is capable of forming the preformed staples into a final U-shaped staple form before effecting the driving and clinching thereof.

As shown, the device 10 includes a main casting or housing, generally indicated at 12, which provides a handle portion 14 adapted to be gripped by the hand of a user, a vertical section 16 extending forwardly and downwardly from the forward end of the handle 14, the upper end portion of the forward section defining a pneumatic cylinder 18. Provided at the lower portion of the vertical housing section 16 is a fastener drive track 20 within which is mounted a fastener or staple driving element 22. Staple driving element 22 is moved through successive operating cycles, each of which includes a downward drive stroke and an upward return stroke by a drive piston 24 slidably sealingly mounted within the pneumatic cylinder 18. A suitable source of supply of air under pressure (not shown) is connected with the device through a nipple 26 which feeds air under pressure to a supply reservoir 28 formed in the lower portion of the handle portion 14 of the housing 12. A double acting valve assembly, generally indicated at 30, when actuated serves to communicate the air under pressure within the reservoir 28 with the cylinder 18 above the piston 24 through a passage 32. It will be noted that the upper end of the cylinder 18 is open and sealingly closed by a cover or cap 34 removably secured therewith, as by peripherally located bolts or the like not shown. Passage 32 leads to the cylinder at a position adjacent to the cap 34 and it will be noted that there is a plug 36 formed in the housing which closes a relief opening leading to the passage 32.

Preferably, the drive piston 24 is mounted within the cylinder 18 for movement by air under pressure from the reservoir 28 both through its downward drive stroke and through its upward return stroke. To this end, a passage 38 leads from the lower end of the cylinder 18 to the valve assembly 30. The valve assembly 30, when actuated, not only serves to communicate the air under pressure within the reservoir 28 with the passage 32 but also serves to correspondingly permit communication of the passage 38 with a exhaust reservoir 40 within the handle 14 above the pressure reservoir 28. Exhaust reservoir 40 leads to the atmosphere through a rearward opening 42.

The valve assembly 30 is manually actuated by a manual actuating mechanism, generally indicated at 44, which is operable to return the valve assembly 30 to its normal inoperative position in response to the completion of the drive stroke of the piston 24. When the valve mechanism 30 is returned, it serves to communicate the pressure reservoir 28 with the passage 38 and the exhaust reservoir 40 with the passage 32, thus effecting the return stroke of the drive piston 24.

The cylinder 18 below the piston 24 is made pressure tight by an O-ring seal 45 mounted within an annular groove formed in a central passage 46 which slidably sealingly receives a piston rod 48 fixedly connected with the piston 24, as by a threaded nut connection of 50. The staple driving element 22 is connected with the lower end of the piston rod 48 through an adjusting mechanism, generally indicated at 52. Mounted on the lower end of the piston rod 48 rearwardly alongside the staple driving element 22 is a staple former, generally indicated at 54, which cooperates with an anvil assembly, generally indicated at 56, mounted in a position to define the rearward lower portion of the drive track 20. The adjusting mechanism 52 also serves to mount a blind clinching assembly, generally indicated at 58, at a position forwardly alongside the staple driving element 22.

The anvil assembly 56 is mounted on a fixed magazine frame structure, generally indicated at 60, for movement in a horizontal direction perpendicular to the vertical extent of the staple drive track 20 from an operative position as shown in FIG. 1, in a rearward direction into a staple clearing position. As shown, a manual moving mechanism, generally indicated at 62, is provided for moving the anvil assembly 56 from its normal operative position into its rearward staple clearing position and for permitting movement in the opposite direction from its staple clearing position back into its operative position.

The magazine frame structure 60 includes appropriate guide surfaces for supporting a staple preform supply which preferably consist essentially of a multiplicity of elongated preform staples interconnected together in parallel relation and rolled up into a coil or roll formation. Preferably, the staple supply is constructed in accordance with commonly assigned U.S. Pat. No. 2,943,436, the disclosure of which is hereby incorporated by reference into the present specification. It will be understood that other similar preform staple supplies may be utilized, see for example, U.S. Pat. Nos. 2,703,402 and 3,335,856. Mounted in cooperating relation with respect to the magazine frame structure 60 is a cover, generally indicated at 64, which is movably mounted between a normally operable position retaining the staple supply within the fixed magazine frame structure and an open loading position, such as shown in the phantom lines in FIG. 1.

The double acting valve assembly 30 may be of any known construction. As shown, the valve assembly consist essentially of two main components, namely an outer sleeve 66 and an inner valve member 68. Sleeve 66 is fixedly mounted within a bore 70 within the housing 12 at a position rearwardly parallel with respect to the cylinder 18. Bore 70 extends upwardly and into communication with the forward end of the exhaust reservoir 40. As shown, the exterior periphery of the sleeve 66 is grooved at four axially spaced locations to receive a series of O-ring seals 72 which engage the interior peripheral wall defining the bore 70. Between the uppermost seal 72 and the next adjacent seal 72, the exterior periphery of the sleeve 66 is formed with an annular groove 74 which communicates with the rearward end of the passage 32. Between the two intermediate O-ring seals 72, the exterior periphery of the sleeve 66 is formed with an annular groove 76 which communicates with the forward end of the supply reservoir 28. Finally, between the two lowermost seals 72, the exterior periphery of the sleeve is formed with an annular groove 78 which communicates with the rearward end of the passage 38. Extending inwardly from each of the annular grooves 74, 76 and 78 is a plurality of annularly spaced radially extending openings 80, 82 and 84. In order to fix the sleeve 66 within the bore 70, the exterior periphery of the sleeve is formed with a lower annular groove for receiving a pin 86 which extends through appropriate openings in the housing.

It will be noted that the lower end of the sleeve 66 is apertured and interiorly grooved to receive an O-ring seal 88 which serves to slidably sealingly engage a depending end portion 90 of the valve member 68 which extends exteriorly downwardly from the handle portion 14 of the housing 12. Formed on the exterior periphery of the valve member 68 upwardly of the depending end portion 90 is a pair of lower flanges which receive an O-ring seal 92 therebetween in a position to slidably sealingly engage the interior of the sleeve 66 on opposite sides of the openings 84. Similarly, there is provided on the exterior periphery of the valve member 68 a pair of upper flanges between which is mounted an upper O-ring 94 which is adapted to slidably sealingly engage the interior of the sleeve 66 at positions on opposite sides of the openings 80. Finally, it will be noted that the valve member 68 is hollow from its upper end downwardly substantially into the depending end portion 90. A radial opening 96 is formed in the valve member 68 at a position below the lower seal 92 in communicating relation with the hollow interior.

A coil spring 98 is mounted in surrounding relation to the upper end portion of the valve member 68 and has its upper end seated in the adjacent portion of the housing and its lower end seated on the uppermost flange containing the seal 94. Spring 98 therefore resiliently biases the valve member 68 into a normally inoperable or lower limiting position, as shown in FIG. 1, and enables the valve member to be moved upwardly therefrom into an actuating or upper limiting position.

Figure 2:
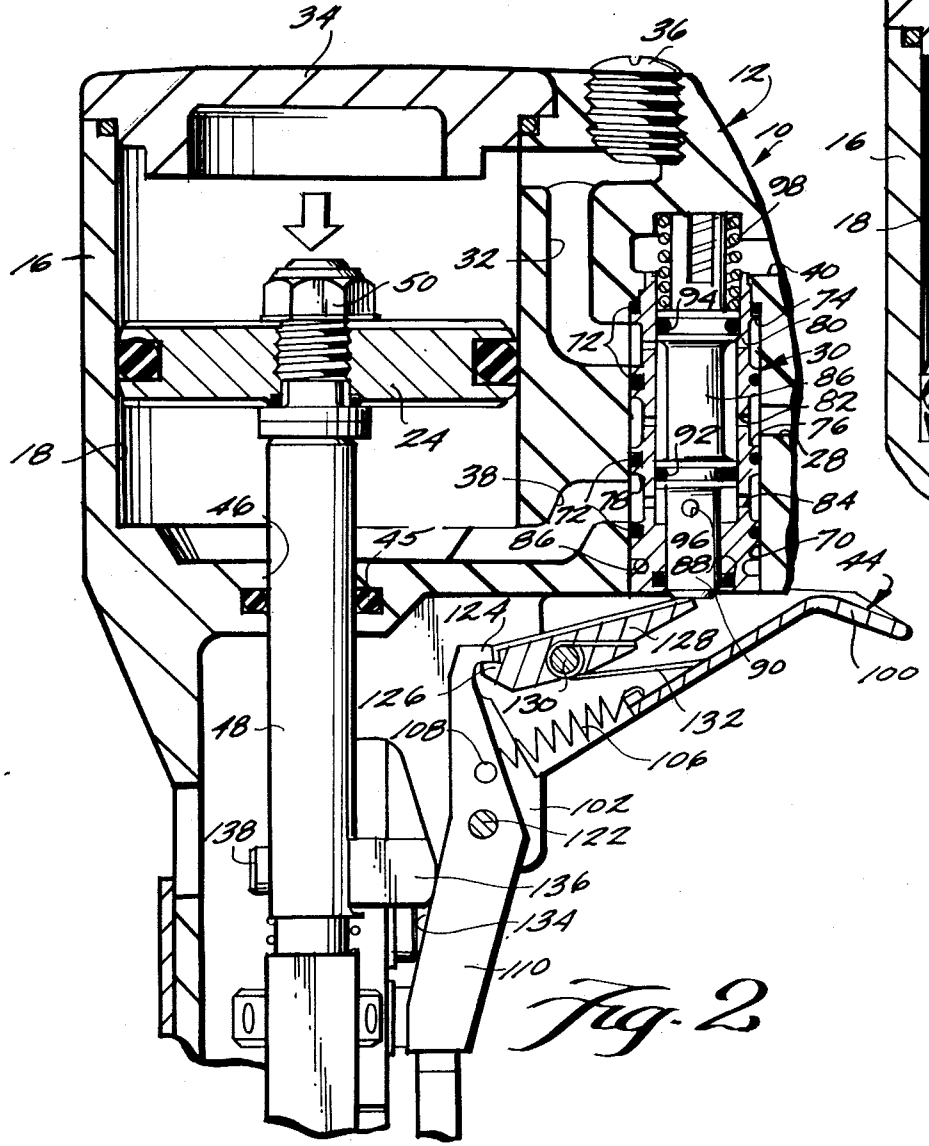
FIG. 2 is an enlarged fragmentary vertical sectional view similar to FIG. 1 illustrating the position of the actuating mechanism after the trigger has been depressed to effect actuation and the drive piston has been moved halfway through its drive stroke.

It can be seen that when the valve member 68 is in its inoperative position, as shown in FIG. 1, the passage 32 is communicated with the exhaust reservoir 40 through annular groove 74 and passages 80. Passage 38 is communicated with the pressure reservoir 28 through annular groove 78, passages 84, passages 82 and annular groove 76. FIG. 2 illustrates the actuating position of the valve member 68 and in this position it will be noted that the reservoir communications with the passages 32 and 38 have been reversed. Thus, passage 32 is now communicated with the pressure reservoir 28 through annular groove 76, passages 82, passages 80, and annular groove 74. Whereas, passage 38 is now communicated with the exhaust reservoir 40 through annular groove 78, openings 84 and the opening 96 within the valve member 68 leading to the hollow interior thereof.

In view of the above it can be seen that when the valve member 68 is moved into its actuating position the pressure conditions within the cylinder 18 are changed so that high pressure is acting on the top of the piston 24 whereas atmospheric pressure is acting on the bottom of piston 24. When these conditions are established the piston 24 is moved through its drive stroke. Conversely, when the valve member 68 is moved back into its inoperative positon, the pressure conditions within the cylinder are reversed so that high pressure is now acting on the lower surface of the piston and atmospheric pressure is acting on the upper surface thereof so as to move the piston through its upward return stroke.

Figure 3:
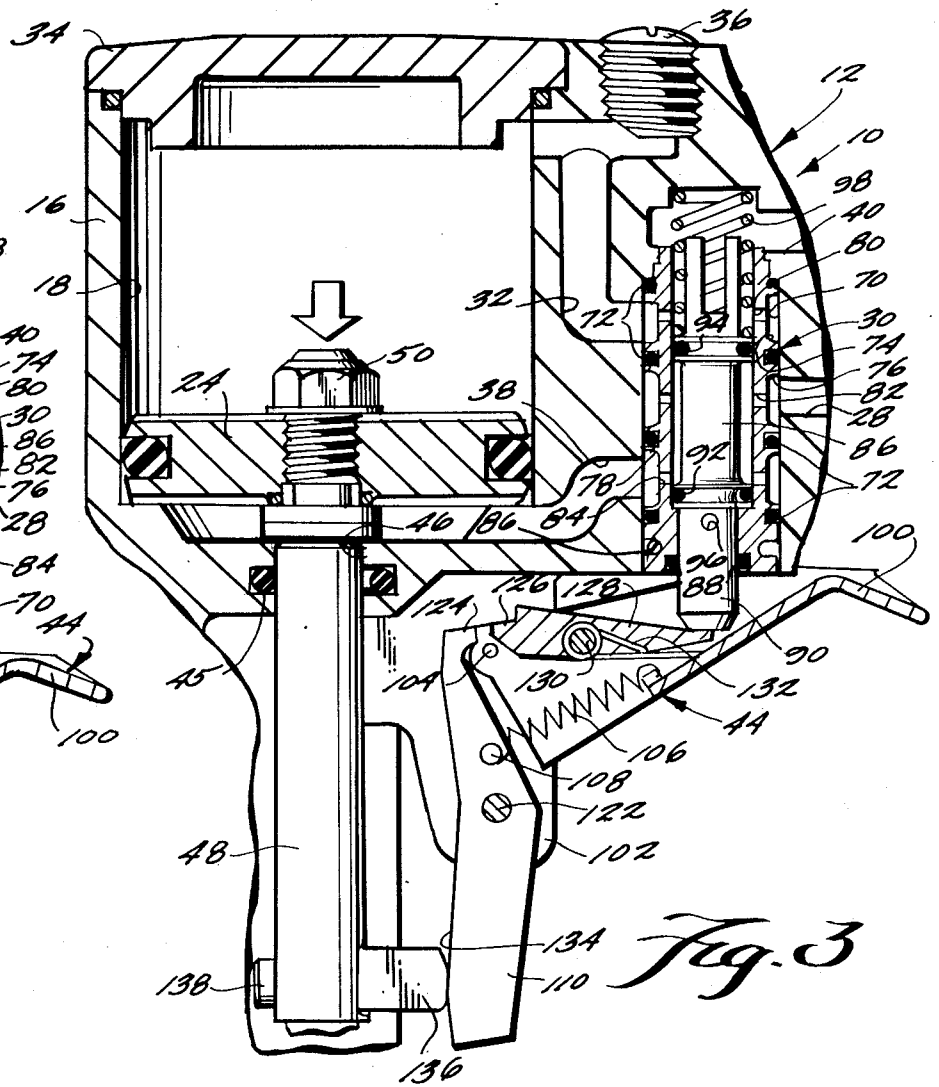
FIG. 3 is a view similar to FIG. 2 showing the position of the parts when the drive piston has reached the end of its drive stroke.
Figure 4:
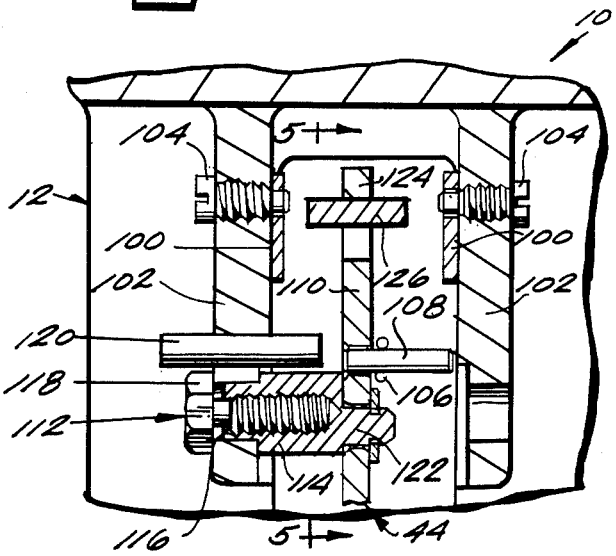
FIG. 4 is an enlarged fragmentary sectional view taken along the line 4—4 of FIG. 1.

As best shown in FIGS. 1–5, the valve actuating mechanism 44 includes a trigger member 100 which is adapted to be digitally engaged by a user grasping the housing handle portion 14. The trigger member 100 is of generally U-shaped configuration in cross section with its legs inverted. The upper forward ends of the legs are pivoted to a pair of spaced depending bracket portions 102 forming a part of the main casting or housing 12. As best shown in FIG. 4, each leg of the trigger member 100 is apertured to receive the end of a pivot pin forming bolt 104 threadedly engaged within the associated bracket position 102. The forward bight portion of the trigger is cut out to form a space for receiving a coil spring 106. One end of the coil spring 106 is connected to the trigger and the opposite end is connected with a pin 108 which extends laterally from a control lever 110.

The control lever 110 is mounted on one of the bracket portions 102 by an adjusting mechanism generally indicated at 112, which provides for the adjustment of the pivotal axis of the control lever 110 with respect to the housing 12. As shown, the adjusting mechanism 112 includes a hexagonal member 114 having one end formed with a concentric cylindrical portion adapted to be rotatably engaged within a cylindrical opening 116 in the associated bracket portion 102. The member 114 is interiorly threaded to receive a mounting bolt 118. The bolt 118 enables the member 114 to be mounted in any one of six different positions of rotational adjustment. In order to positively retain the member 114 in any related position of adjustment a pin 120 is extended through the associated bracket portion 102 so that its inner end is disposed above the uppermost flat of the hexagonal member 114.

Extending from the end of the hexagonal member opposite from the bolted end thereof is an eccentric pivot portion 122 which extends through the central portion of the control lever 110 in a position below the pin 108. It will be noted that the trigger return spring 106 thus serves to resiliently bias the trigger member 100 for pivotal movement about its pivotal axis in a clockwise direction as viewed in FIG. 1 and the control lever 110 about its pivotal axis also in a clockwise direction as viewed in FIG. 1.

The upper end of the control lever 110 includes a rearwardly extending hook portion 124 which is adapted to engage a cooperating ledge portion 126 formed on the forward end of an actuating lever 128. The actuating lever 128 is pivoted intermediate its ends to the trigger member 100, as by a pivot pin 130 extending therethrough and through the upstanding leg portions of the trigger at a position rearwardly of the pivot bolts 104. The rearward end of the actuating lever 128 includes an upwardly facing surface which engages the downwardly facing surface of the depending end portion 90 of the valve member 86. It will also be noted that the actuating lever 128 has operatively associated therewith a hairpin spring 132 which acts between the actuating lever and the trigger to resiliently bias the actuating member in a counterclockwise direction as viewed in FIG. 1 so as to insure that the rearward end thereof will engage the lower end portion 90 of the valve member 68. Spring 132 has a strength considerably less than the spring 98.

When the trigger member 100 is in its normal inoperative position as shown in FIG. 1, the arrangement is such that the interengagement of the control lever with the actuating lever controls the actuating lever in such a way that it moves with the trigger member about the pivotal axis of the trigger member. Thus, when the rearward end portion of the trigger member 100 is digitally engaged and moved upwardly, the rearward end of the actuating member 128 serves to move the valve member 68 upwardly from its normal inoperative position into its actuating position as shown in FIG. 2.

The lower portion of the control lever 110 is provided with a cam surface 134 which is adapted to be engaged by a cam member 136 fixed to the piston rod 48, as by a bolt 138, at a position just above the adjusting mechanism 52. Consequently, as the drive piston 24 is moved toward the end of its drive stroke, the cam member 136 will engage the cam surface 134 of the control lever 110, as shown in FIG. 3, so as to effect a pivotal movement of the control lever about its pivot pin 122 in a counterclockwise direction as viewed in FIG. 3. This movement serves to disengage the hooked end portion 124 of the control lever from the ledge portion 126 of the actuating lever 128. As previously indicated, since the valve spring 98 resiliently biasing the valve member 68 downwardly is stronger than the spring 132 resiliently biasing the actuating member 128 upwardly, the valve member 68 is moved downwardly by the action of the spring 98 into its normal inoperative position, as shown in FIG. 3, carrying with it the rearward end of the actuating member 128.

Figure 5:
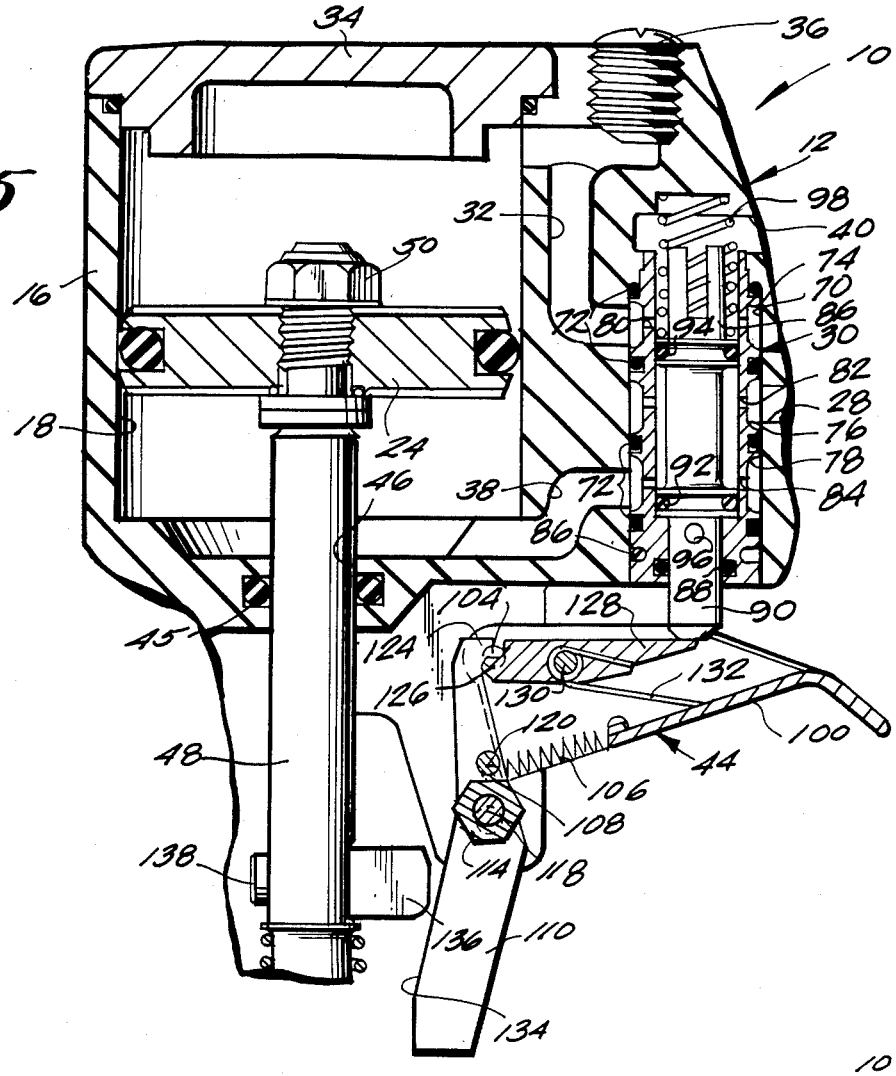
FIG. 5 is a view similar to FIGS. 2 and 3 except that the section of the actuating mechanism has been taken along the line 5—5 of FIG. 4, the position of the parts being shown after the drive piston has moved halfway through its return stroke.

In this way, the valve member is returned to it inoperative positon and the pressure conditions acting on the drive piston 24 are reversed causing the drive piston to be moved through its return stroke irrespective of whether or not the user releases the trigger to allow the same to move downwardly into its inoperative position. As the drive piston moves upwardly cam 136 moves away from the cam surface 134 allowing the control lever 110 to pivot about its pivot pin 122 in a clockwise direction as viewed in FIG. 5 thus positioning the upper hooked end portion 124 in a position to be engaged by the forward ledge portion 126 of the actuating member 128 when the trigger member 100 is released. This position is illustrated in FIG. 5. It will be understood that the adjusting mechanism 112 allows the operator to choose the position at which the cam 136 engages the cam surface 134 during the drive stroke of the drive piston 24.

Figure 6:
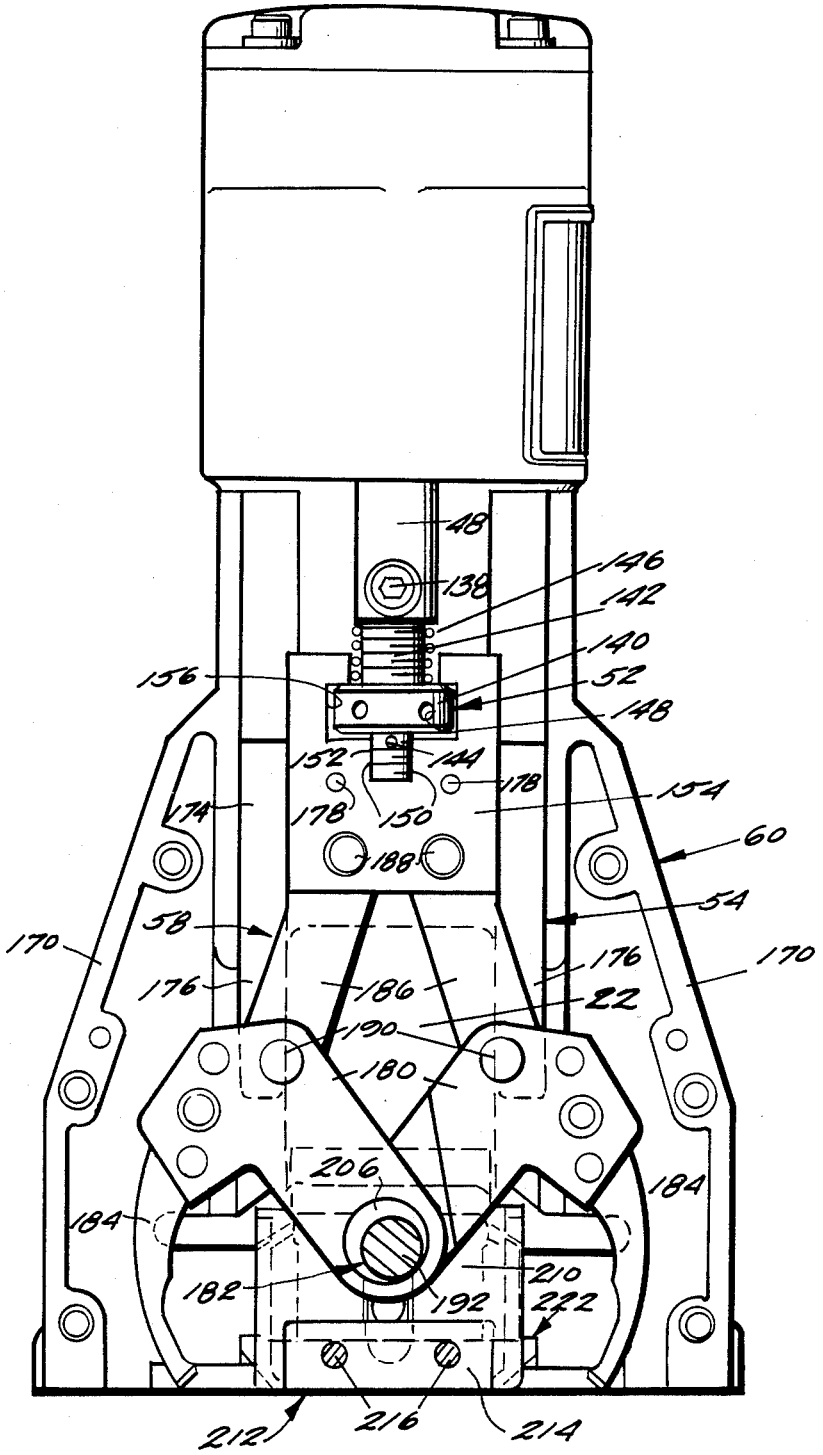
FIG. 6 is an enlarged fragmentary sectional view taken along the line 6—6 of FIG. 1.

Referring now more particularly to FIGS. 1 and 6 the adjusting mechanism 52 includes a disc 140 which is centrally apertured and threadedy engaged on a depending end portion 142 of the piston rod 48. A stop pin 144 extends through the lower extremity of the threaded portion 142 to limit the downward movement of the threaded disc 140 on the threaded end portion 142. A coil spring 146 surrounds the end portion 142 and serves to resiliently urge the disc downwardly so as to prevent accidental turning thereof. The disc 140 is turned by engaging a rod or similar tool in a selected one of a series of annularly spaced radially extending bores 148 extending radially inwardly from the periphery of the disc.

The lower extremity of the piston rod end portion 142 is formed with a pair of flat surfaces 150. These surfaces are engaged within a slot 152 formed in a central portion of a mounting block 154 which forms a part of the blind clinching mechanism 58 and as a support for the staple driving element 22 and the former 54. The upper end portion of the mounting block 154 is formed with an inverted T-shaped slot 156 which receives the disc 140 and piston rod end portion 142 therein.

The forward surface of the mounting block 154 is guided vertically by rearwardly facing guide surfaces 158 formed on the lower rearward portion of the vertical housing section 16. Mounted on the forward exterior of the lower portion of the housing section 16 is a front cover member 160 which is of generally flanged U-shaped cross-sectional configuration. The bight portion of the cover member 160 fits over the lower portion of the vertical housing section 16 with the flanges extending laterally outwardly therefrom. The cover 160 is vertically adjustably positioned on the housing by a single bolt 162 extending through a rectangular washer 164 and a vertically elongated opening 166 in the cover and into the lower end portion of the housing section 16. Preferably, the rear face of washer 164 and the adjacent forward face of cover member 160 are provided with mating vertically spaced horizontally extending serrations (not shown) to insure against slippage.

Figure 10:
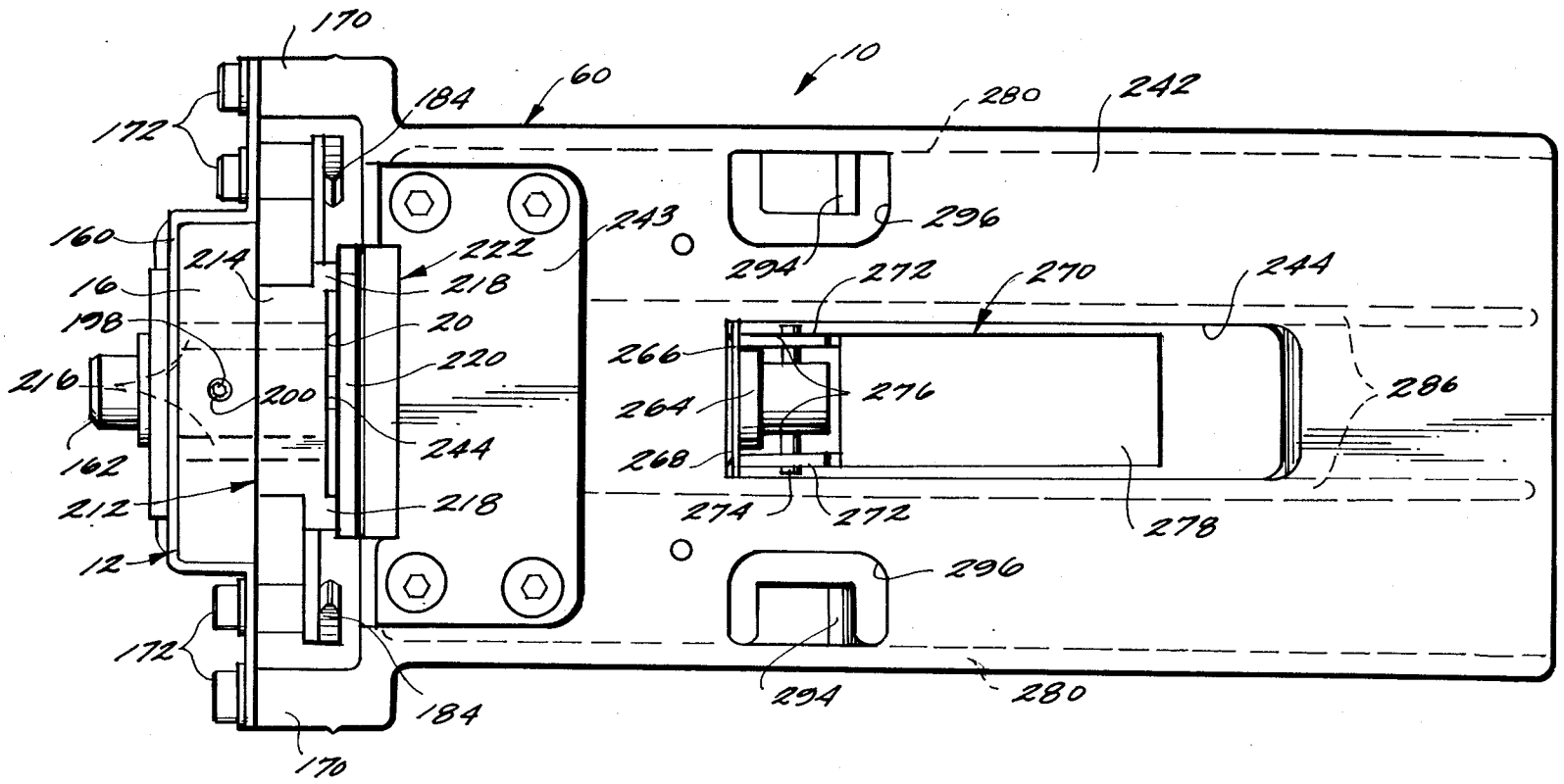
FIG. 10 is a bottom view of the fastener driving device.

The cover member 160 is adapted to be moved vertically in conjunction with the adjustment of the adjusting mechanism 52. As best shown in FIG. 1, the forward portion of the housing section 16 which is forwardly of the disc 140 is apertured, as indicated at 168, to provide access to the disc 140. The flanges of the cover plate 160 are adapted to be connected with a pair of laterally and vertically extending flange sections 170 forming a part of the fixed magazine frame structure 60. As best shown in FIG. 10, the flanges of the cover 160 are secured to the sections 170 by a series of bolts 172.

As previously indicated, the mounting block 154 not only forms a part of the blind clinching mechanism 58 but serves to fixedly mount the staple driving element 22, which is in the form of a rectangular blade, and the former 54, which is in the form of an inverted U-shaped plate providing an enlarged bight portion 174 having a pair of spaced parallel leg portions 176 extending downwardly therefrom. A pair of bolts 178 extend through the bight portion 174, the upper end portion of the staple drive element 22 and into the mounting block 154 to effect the fixed mounting of the staple driving element and former to the mounting block 154.

As best shown in FIG. 6, the blind clinching mechanism 58 includes a pair of clincher arms 180 which are pivoted to the lower end of the vertical housing section 16 by an adjustable pivot member generally indicated at 182. Each clincher arm 180 has mounted on the outer end thereof an arcuate clincher anvil 184 which, when the clinching mechanism is disposed in its retracted position, as shown in FIG. 6, extends arcuately downwardly from the end of the associate arm 180. The clincher arms 180 are formed with interior grooves in accordance with conventional practice to receive the ends of the legs of a staple being driven to guidingly move the legs inwardly to effect clinching thereof. In order to accomplish the clinching action the clinching anvils must be moved downwardly and inwardly along an arcurate path into a clinching position and this movement is accomplished in response to the downward movement of the mounting block 154 by means of a pair of links 186 pivoted at their upper ends to the mounting block, by pivot pins 188, and at their lower ends to an upper intermediate portion of an associated clincher arm 180, as by a pivot pin 190.

Referring now more particularly to FIGS. 1 and 7–9, the construction and operation of the adjustable pivot assembly 182 of the blind clincher mechanism 58 is shown therein. As shown, the adjustable pivot assembly is in the form of a single member which includes a forward cylindrical portion 192 which is rotatably mounted within a cylindrical opening 194 formed in the lower end portion of the vertical housing section 16. The forward cylindrical portion 192 of the adjustable pivot member 182 has a vertical bore 196 extending therethrough which is countersunk at both ends to receive the end of a set screw 198 threadedly engaged within an apertured bore 200 extending upwardly from the lower surface of the housing section 16. It can be seen that the cylindrical portion 172 is capable of being locked into either one of two positions of rotation which positions are displaced 180° with respect to one another. As best shown in FIGS. 7–9 the forward face of the cylindrical portion 192 is slotted, as indicated at 202, to receive a turning tool and the remaining face may be provided with indicia for indicating which of the two positions the forward portion 192 is in. An opening 204 is formed in the cover 160 to provide both visual and tool access to the forward surface of the pivot portion 192. The adjustable pivot member 182 includes a first eccentric pivot portion 206 which is adjacent the rear surface of the forward cylindrical portion 192 and a spaced rearward eccentric pivot portion 208.

FIG. 7 illustrates one position of the adjustable pivot member 182 which is utilized when staples having a relatively short leg length are utilized. As shown in FIG. 7, indicia S appears at the top face of the forward cylindrical portion 192 above the slot 202. The center of the eccentric pivot portion 206 is offset from the center of the cylindrical portion 192 both horizontally to the left and vertically upwardly whereas the center of the eccentric portion 208 is offset from the center of the cylindrical portion 192 in a horizontal direction to the right and a vertical direction upwardly. FIG. 9 illustrates in solid lines the position of the clinching anvils 184 and other components of the clinching mechanism 58 when the adjustable pivot member 192 is in the position shown in FIG. 7. FIG. 8 illustrates the other position of the adjustable pivot member 182 which is displaced 180° from the position shown in FIG. 7. It will be noted that the indicia L is now located above the slot 202 indicating that staples having legs of a longer length can now be accommodated. It is noted that the eccentric pivot portion 26 is now disposed with its center displaced from the center of the cylindrical portion 192 in a horizontal direction to the right and in a vertical direction downwardly. Similarly, the eccentric pivot portion 208 has its center displaced from the center of the cylindrical portion 192 in a horizontal direction to the left and in a vertical direction downwardly. The position of the clinching anvils 184 and other components of the clinching mechanism 58 when the pivot member 182 is disposed in the position shown in FIG. 8 is illustrated in phantom lines in FIG. 9. It is significant to note that the lower points of the clinching anvils both when retracted and extended are moved relative to one another in a direction horizontally toward one another and downwardly when the pivot member 182 is moved from the position shown in FIG. 7 to the position shown in FIG. 8.

As best shown in FIGS. 1, 6, and 10–15, the rearward surface of the eccentric portion 208 engages the forward surface of an upstanding plate portion 210 of a guide member, generally indicated at 212. Guide member 212 includes a lower mounting portion 214 which extends forwardly from the lower forward surface of the plate portion 210 and has a pair of openings therein for receiving guide pins 216 (see FIGS. 2 and 10) which also extend into registering guide holes in the lower end of the housing portion 16.

The rearward surface of the plate portion 210 of the guide member 212 defines the lower forward surface of the guide track 20. The vertically coextensive sides of the drive track are defined by a pair of vertically extending elongated track defining end portions 218 protruding rearwardly along opposite vertical marginal edges of the plate portion 210 of the guide member 212. The end portions 218 include opposed drive track side defining surfaces which are spaced from each other except at their lower ends a distance greater than the dimension of the staple crown. At their lower ends, the drive track side defining surfaces merge toward one another to a spacing just slightly greater than the staple crown width.

The rearward surface of the lower end of the drive track 20 is defined by the forward surface of an inverted T-shaped plate portion 220 of an anvil member, generally indicated at 222, forming a part of the movable anvil assembly 56. Extending rearwardly from the upper marginal edge of the plate portion 220 of the anvil member 222 is an upper horizontal wall portion 224. A lower horizontal wall portion 226 extends rearwardly along an upper margin of the inverted T in parallel relation to the upper portion 224.

Slidably mounted between the horizontal wall portions 224 and 226 is a staple feeding member, generally indicatd at 228. Staple feeding member 228 includes an upright body portion 230 which is slidably mounted on opposed guide surfaces on the wall portions 224 and 226 for movement between a forward limiting position, as shown in FIGS. 11 and 13–15, and a rearward limiting position. The staple feeding member 228 includes a pair of staple leg engaging portions 232 extending along the vertical marginal edges of the body portion 230 forwardly beyond the adjacent side surfaces of the plate portion 220 of the anvil member 222 when the staple feeding member 228 is in its forward limiting position. The inner marginal edges of the forward surfaces of the staple leg engaging portions 232 define corresponding sections of the drive track 20.

Figures 11, 12:
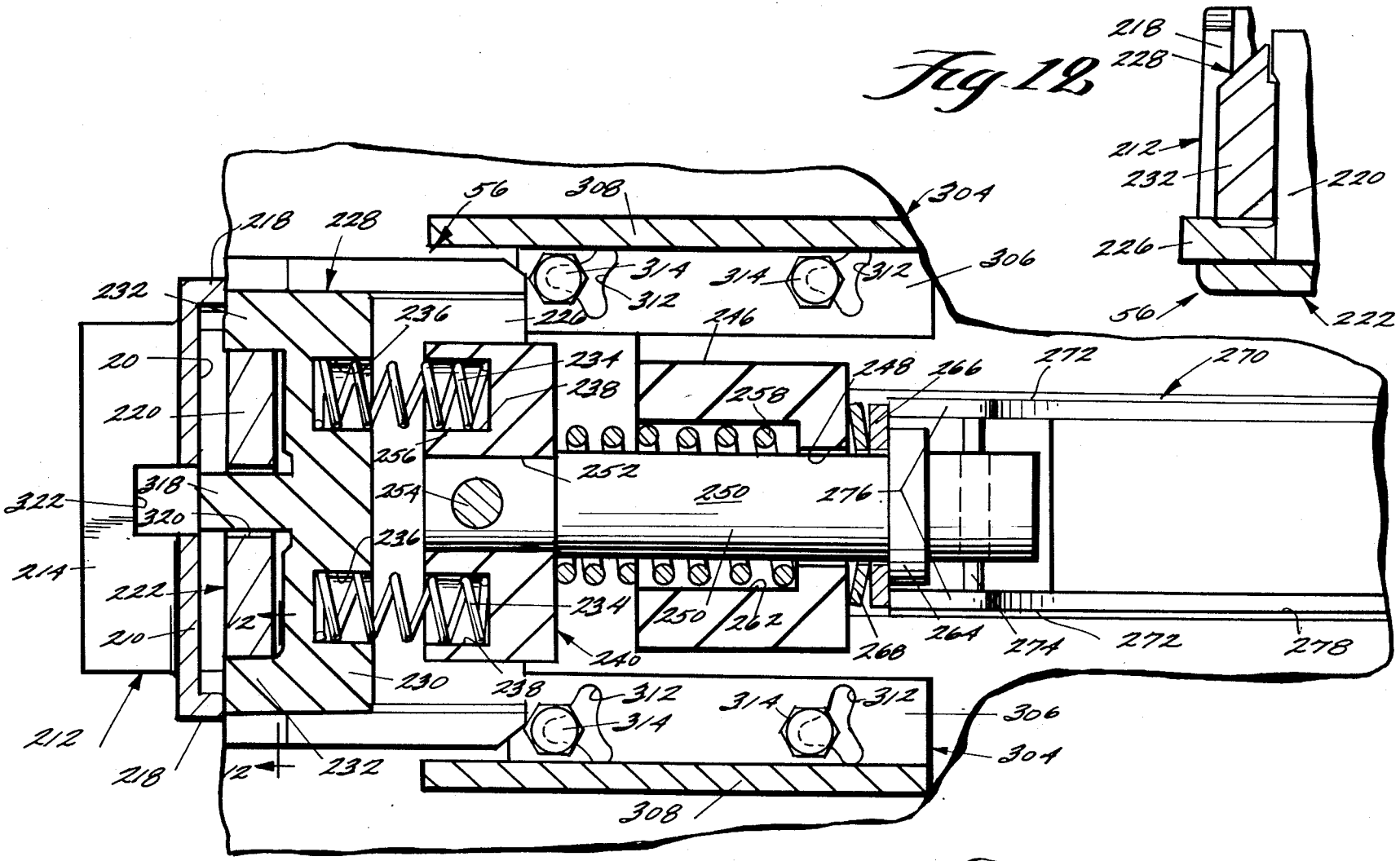
FIG. 11 is an enlarged fragmentary sectional view taken along the line 11—11 of FIG. 1.
FIG. 12 is an enlarged fragmentary sectional view taken along the line 12—12 of FIG. 11.
Figure 15:
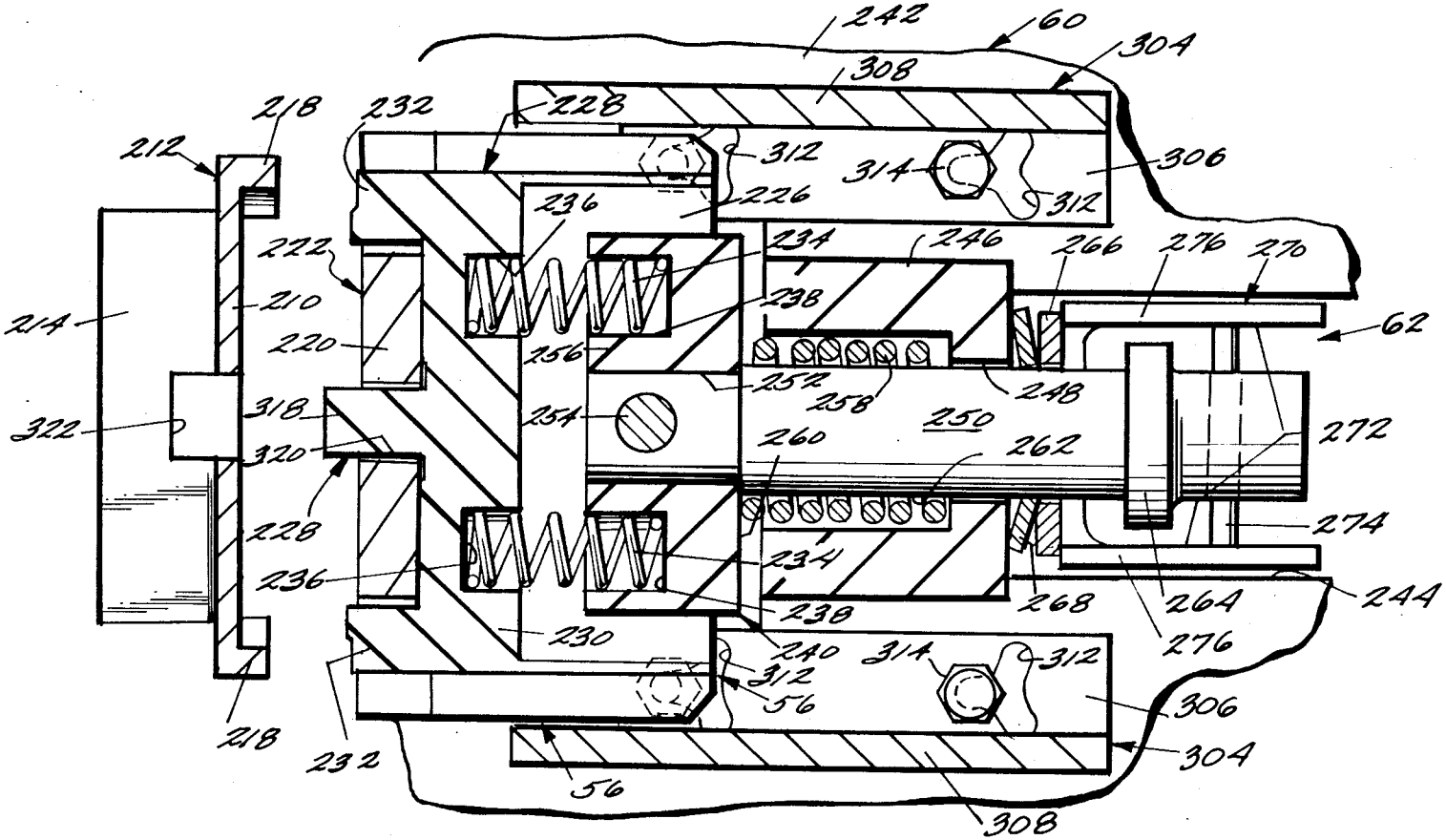
FIG. 15 is a view similar to FIG. 11 showing the parts in the position similar to FIG. 14.
Figure 16:
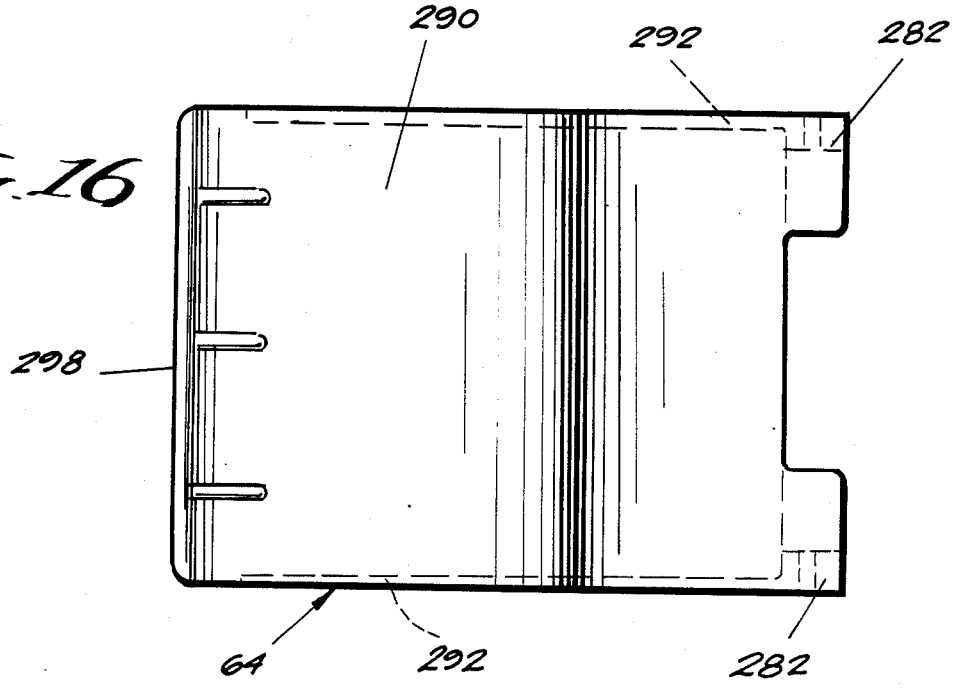
FIG. 16 is a top plan view of the staple preform roll cover.
Figure 17:
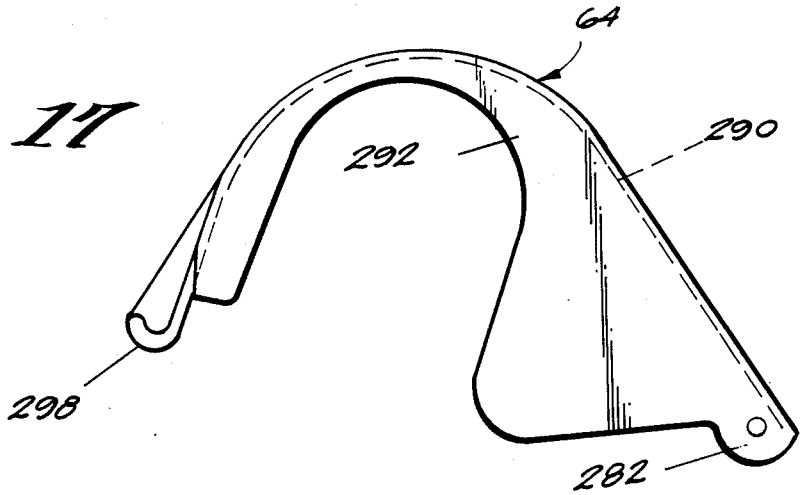
FIG. 17 is a side elevational view of the cover shown in FIG. 16.

The staple leg engaging member 228 is resiliently biased into its forward limiting position by means of a pair of compression coil springs 234. As best shown in FIGS. 11 and 15, the forward ends of the springs 234 are seated within blind holes 236 formed in the body portion 230 of the staple leg engaging member 228 while the rearwards ends thereof are seated within blind holes 238 formed in an anvil cap member, generally indicated at 240, forming a part of the anvil assembly 56.

Anvil cap member 240 is suitably fixed to the anvil member 222, which completes the mounting of the staple feeding member 228 within the anvil assembly 56, for horizontal reciprocating movement with respect to the anvil assembly 56 and for movement with the anvil assembly 56 under the action of the manual moving mechanism 62.

Figure 13:
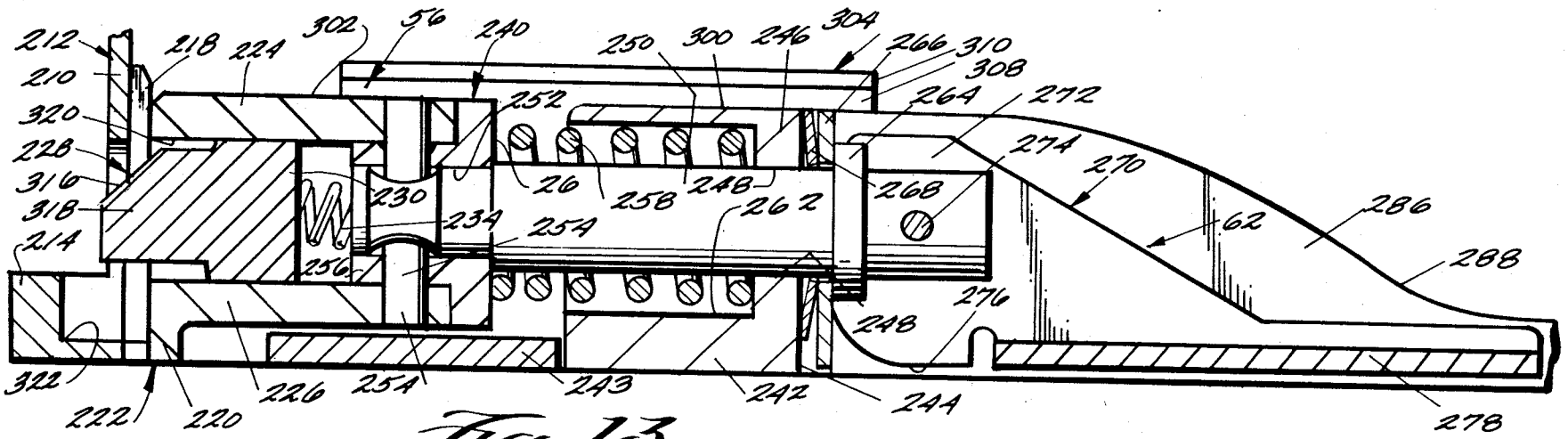
FIG. 13 is a sectional view taken along the line 13—13 of FIG. 11.
Figure 14:
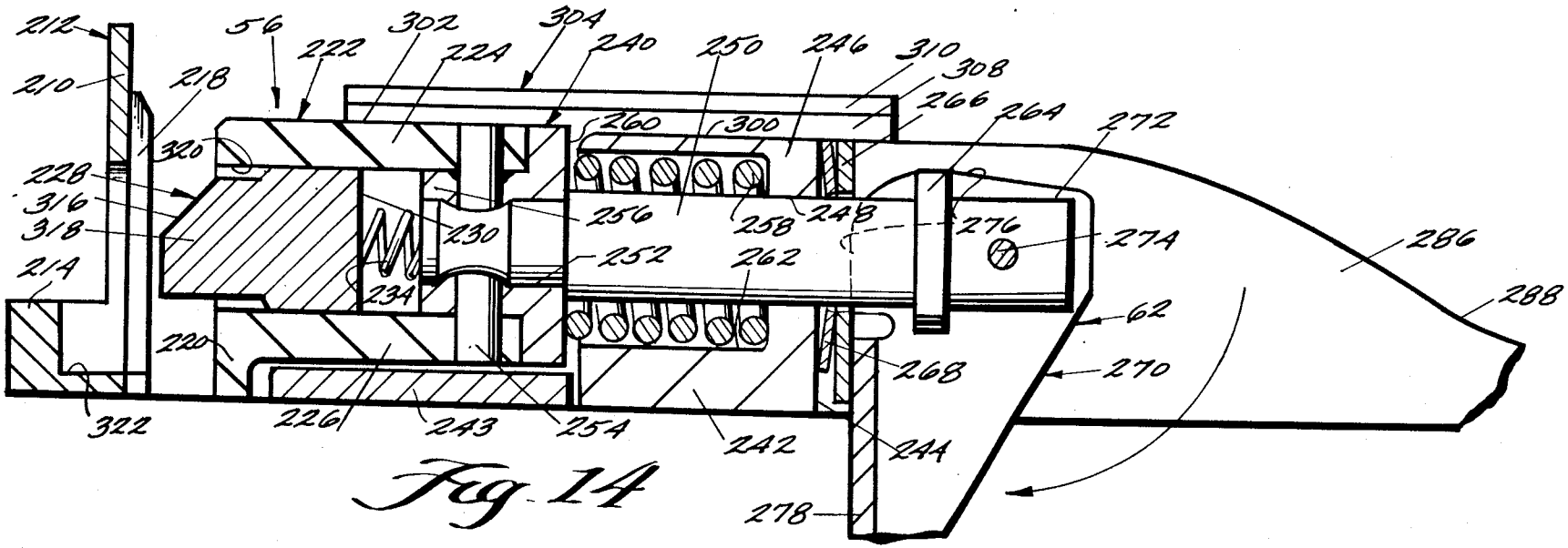
FIG. 14 is a view similar to FIG. 13 showing the parts in the position into which they are moved in order to effect clearance of the drive track from a staple jam.

The anvil assembly 56 is mounted within the frame structure 60 for movement between a forward normal operating position, as shown in FIGS. 1, 11 and 13, and a rearward staple clearing position, as shown in FIGS. 14 and 15. As best shown in FIG. 10, the frame structure 60 includes a horizontally extending generally rectangular bottom plate section 242 having a generally rectangular opening 244 formed in the central portion thereof and a forwardly spaced recess closed by a removable plate 243. Formed integrally on the upper surface of the bottom section 242 in a position between opening 244 and plate 243 is an upstanding central mounting block section 246. Mounting block section 246 has a central bore 248 extending horizontally therethrough within which is slidably mounted a mounting shaft 250. Shaft 250 includes a forward end portion of reduced diameter which extends into a central bore 252 formed in the anvil cap member. The reduced end portion of the mounting shaft 250 is fixed within the bore 252 by a crosspin 254 which extends vertically through the anvil member 224, a forward cylindrical projecting portion 256 of the anvil cap member 240 and the reduced end of the shaft 250.

The anvil assembly 56 is resiliently biased into its forward normal operating position, as shown in FIGS. 1, 10, 11 and 13, by a compression coil spring 258 surrounding the mounting shaft 250 and having its forward end seated against a rearwardly facing surface 260 of the anvil cap member. The rearward end portion of the coil spring 258 seats within a forwardly opening counterbore 262 formed in bore 248 of the block frame section 246. As previously indicated, the outer marginal edges of the forwardly facing surfaces of the anvil portions 232 engage the projections 218 to define the forward operating position. To further aid in limiting the movement of the anvil member 228 into its forward normal operating position, mounting shaft has an annular abutment flange 264 on the portion of the exterior periphery disposed rearwardly of the block 246. The forward surface of the abutment 264 engages a square washer 266. Disposed between the washer 266 and the block is a Belleville spring 268. The manual moving mechanism 62 serves to move the anvil assembly 56 into its rearward staple clearing position against the bias of spring 258 and includes a manually engagable lever, generally indicated at 270. Lever 270 includes a pair of forward parallel plate portions 272 which are pivoted to the rearward end portion of the mounting shaft 250, as by a pivot pin 274. The plate portions 272 have forwardly and downwardly facing arcuate cam surfaces 276 which are engagable with the rearwardly facing surface of the washer 266. The lever 270 also includes a normally rearwardly extending manually engagable portion 278. The normally downwardly facing portions of the cam surfaces 276 are spaced from the pivot pin 274 a greater distance than the normally forwardly facing portions thereof. Consequently, when the lever portion 278 is disposed in its normally rearwardly extending position within the opening 244, the anvil assembly 56 is disposed in its normal operative position as shown in FIGS. 1, 11 and 13. When the lever portion 278 is manually moved downwardly, the shape of the cam surfaces 276 is such as to cause the anvil assembly 56 to be moved into its rearward staple clearing position, as shown in FIGS. 14 and 15. Moreover, the shape of the cam surfaces 276 is such that the lever portion 278 and anvil assembly 56 will remain in the staple clearing position until the lever portion is manually moved at least a predetermined portion toward its normal operating position.

With the above in mind, the structure for handling the staple preform supply between the frame structure 60 and cover 64, for guiding a leading end portion of the supply over the anvil assembly 56, where a leading staple preform is formed into a U-shape, and then into the drive track 20 for driving and for feeding or advancing the staple supply end portion after each driving operation, will now be described. As best shown in FIGS. 1 and 10, frame structure 60 includes a pair of upstanding side wall sections 280 formed integrally with the bottom wall section 242 along opposite side edges thereof. Cover 64 includes a pair of spaced pivot lugs 282 which engage between the rearward ends of the side wall lugs 280. A pivot pin 284 extends through apertures in the rearward ends of the side wall sections 280 and the lugs 282. Pin 284 serves to pivot the cover 64 between a closed operative position, as shown in solid lines in FIG. 1, and an opened access position, as shown in phantom lines in FIG. 1.

Formed integrally with the bottom section 242 between the side wall sections 280 is a pair of upstanding central rib sections 286 which are apertured at their rear ends to receive the pivot pin 284 therethrough. The rib sections 286 have upper surfaces 288 which, at a position forwardly of the rear ends thereof, are configured in an upwardly facing concave shape suitable for engaging and turnably supporting a roll of preform staples.

Cover 64 which is preferably molded of a suitable plastic material, as, for example, polyethylene, includes a normally downwardly concavely curved peripheral wall 290 having a pair of marginal side walls 292 extending downwardly along the curved edges of the peripheral wall 290. As shown in solid lines in FIG. 1, when the cover is in its normal closed operative position, the peripheral wall 290 encloses the staple roll supply supported on the concave surfaces 288 of the rib sections 286. It will also be noted that side walls 292 are spaced on opposite sides of the roll so as to retain it against substantial side movement and at the same time to enable the sides of the roll to be exteriorly viewed so that the user may readily tell when the supply needs replenishing.

As best shown in FIG. 1, the side wall sections 280 are formed with integral cover locking elements 294 which extend inwardly therefrom at positions adjacent the forward end of the opening 244 in bottom section 242. Bottom section 242 has apertures 296 formed therein which enable locking elements 294 to be cast as an integral part of the frame structure 60, see FIG. 10. The locking elements 294 are adapted to cooperate with locking surfaces 298 formed on an upwardly curled forward end of the cover peripheral wall 290. It will be noted that the polyethylene material of the cover 64 and the configuration of the peripheral wall 290 and side walls 292 are such as to enable the forward end portion of the cover 64 when in its closed position to be resiliently deflected in a direction toward the rearward pivoted end thereof so as to enable the locking surfaces 298 to be released from the locking elements 294 so as to allow the user to move the cover 64 upwardly from its closed position shown in full lines in FIG. 1 into its opened access position shown in phantom lines in FIG. 1. In a similar manner, when it is desired to close the cover after having replenished the preform staple supply the user need only push down on the cover and the interengagement of the locking surfaces 298 with the locking elements will cam the forward end of the cover rearwardly to allow the cover 64 to move into its closed position in releasably locked relation with locking surfaces 298 below the locking elements 294.

Referring now more particularly to FIGS. 13 and 14 it will be noted that the concave upper surfaces 288 of the central rib section 286 extend horizontally forwardly to an upwardly facing surface 300 of the central block section 246. The surface 300 serves to support a leading end portion of the preform staple supply for forward movement from the rib surfaces 288 onto an aligned upwardly facing surface 302 of the anvil assembly 56. As best shown in FIGS. 11 and 15, during this movement, the leading end portion of the preform staple supply is guided laterally by a pair of guide members, generally indicated at 304. Each guide member 304 is preferably formed of sheet metal bent to provide a lower mounting section 306, an upstanding guide section 308 and an inwardly extending flange guide section 310. Each mounting section 306 is formed with a pair of openings 312 of rounded corner triangular configuration for receiving mounting bolts 314 suitably threaded into the adjacent frame structure 60. By shifting each mounting section 306 into a position in which the bolts 314 are disposed within a selected one of the three rounded corners of the openings 312, the guide members can be fixed into any one of three differently spaced apart positions accommodating three different staple preform lengths.

It will be noted that when the leading preform staple of the leading end portion of the supply is initially moved toward the drive track 20 it can not enter until it has been formed into a U-shaped configuration. It will also be noted that the thickness of the inverted U-shaped former 54 is equal to the width of two staple preforms. Consequently, during an initial drive stroke of the drive piston 24, the former 54 will serve to form the two leading staple preforms into a U-shaped configuration as the former leg portions 176 move downwardly into engagement with the ends of the staple preforms extending beyond the anvil surface 302. However, before this forming action takes place, the staple leg engaging portions 232 of the staple feeding member 228 must be moved into a position rearwardly of former leg portions 176 so as not to interfere with the movement, which position corresponds to the rearward limiting position of the staple feeding member 228.

The staple feeding member 228 is moved toward its rearward limiting position against the bias of springs 234 by means of an inclined cam surface 316 formed on an integral projecting portion 318 extending forwardly from the center of the body portion 230. When the staple feeding member 228 is in its forward limiting position, as shown in FIGS. 14 and 15, the projecting portion 318 extends through a registering opening 320 formed in the body portion 220 of the anvil member 222 and a central recess 322 formed in the member 212.

It can be seen that by positioning the staple feeding member 228 in its rearward limiting position the forward surfaces of the projecting portions 232 thereof will be disposed rearwardly of the downwardly extending legs formed on the two leading staples. As the fastener driving element 212 moves upwardly during its return stroke, the bottom surface of the fastener driving element moves upwardly into engagement with the cam surface 316 and upon further movement after the leading staple crown has been cleared the staple feeding member 228 is allowed to move forwardly under the action of springs 234 toward its forward limiting position. During this movement the leading surface of the projecting portions 232 of the staple feeding member 228 will engage the legs of the second staple formed and move the leading formed staple into the drive track 20. Thus, after an initial operation of the device the leading staple preform will have been formed into a final U-shaped configuration and moved into the drive track 20 beneath the fastener driving element 22. In addition, the second staple preform will have been formed into its U-shaped configuration. In order to prevent movement of the staple end portion in a rearward direction, there is provided an L-shaped guide member 324 which is fixed to the frame structure 60 in a position adjacent the drive track 22. The L-shaped guide member 324 includes a central resilient ratchet-like element 326 which is adapted to engage between the central portion of successive staple preforms.

With the device 10 provided with a staple preform supply in the manner indicated above with the leading staple preform being already formed in a U-shaped configuration and disposed within the drive track, it will be understood that when the user actuates the trigger member 100, the drive piston 24 will be moved through a drive stroke carrying with it the fastener driving element 22, the former 54 and the blind clinching mechanism 58. During the initial portion of the drive stroke, the lower end of the fastener driving element 22 engages the crown of the staple within the drive track 20 and moves the same downwardly. During the initial portion of this downward movement, the crown of the staple engages the cam surface 316 of the projecting portion 318 of the staple feeding member 228 causing the same to move rearwardly into its rearward limiting position. Immediately following this action the leg portions 176 of the former 54 engage the ends of the staple preform which is adjacent the staple preform next to the drive track which has already been formed. Thus, as the drive stroke of the drive piston 24 continues the staple within the drive track continues to be moved downwardly while the third staple preform continues to be formed into a U-shaped configuration. In addition, the blind clinching mechanism 58 is operated so that the clinching anvils 184 thereof are moved into a position to receive the free ends of the legs of the staple being driven as the latter move outwardly of the lower end of the drive track 20 and into the work piece. By the end of the drive stroke of the drive piston the legs of the driven staple are clinched on the clinching anvils 184 and the second staple preform has been formed into a U-shaped configuration with the legs thereof positioned forwardly of the projecting portions 232 of the staple feeding mechanism.

As previously indicated, the return stroke of the drive piston 24 is initiated by virtue of the movement of the lever 110 by engagement of the cam member 136 with the cam surface 134 thereof. During the initial portion of the return stroke, the clinching anvils 184 of the blind clinching mechanism 58 are retracted, the fastener driving element 22 is moved upwardly and the former 54 is moved upwardly. As the fastener driving element 22 moves upwardly it moves out of engagement with the projecting portion 318 of the staple feeding member 228 thus releasing the latter for forward movement under the bias of springs 234. This forward movement however cannot take place because the projecting portions 232 of the staple feeding member 228 are in engagement with the legs of the second formed staple and the latter cannot move forwardly because the crown of the abutting leading staple is in engagement with the fastener driving element 22. As soon as the lower end of the fastener element 22 clears the leading staple crown, springs 234 serve to move the entire staple preform end portion forwardly so that the leading staple moves into the drive track completing the cycle.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a stapling device comprising a housing defining a drive track, a staple driving element mounted in said drive track for vertical movement through a staple driving stroke and a return stroke, an anvil having a forwardly facing surface means defining the rearward lower end of said drive track and upwardly facing surface means for receiving successive staple crowns with the legs thereof extending outwardly from the crown, a former mounted for movement with said staple driving element through a forming stroke in cooperating relation with said anvil so as to bend downwardly the legs of a staple whose crown is supported on the upwardly facing surface thereof and a return stroke during the drive stroke and return stroke respectively of said staple driving element, a staple feeder mounted on said anvil for movement with respect thereto from a retracted position through a staple feeding stroke in a lateral direction toward said drive track into an extended position and a return stroke, a spring for resiliently biasing said feeder into its extended position, said feeder having cam surface means disposed within said drive track when said feeder is beyond said retracted position engageable (1) during the drive stroke of said staple driving element so that said feeder is moved through a return stroke against the bias of said spring and (2) during the return stroke of said staple driving element so that said spring moves said feeder through a staple feeding stroke, said feeder having means for engaging the bent down legs of a formed staple when in its retracted position so that a formed staple will be moved laterally into the drive track during the staple feeding stroke of said feeder, the improvement which comprises means mounting said anvil, said feeder and said spring on said housing for movement from an operative position in a lateral direction away from said drive track into a staple clearing position and from said staple clearing position in a lateral direction toward said drive track into said operative position, and manually operable means for effecting movement of said anvil, said feeder and said spring from said operative position into said staple clearing position.

2. The improvement as defined in claim 1 wherein said mounting means includes spring means for resiliently biasing said anvil, said feeder and said spring into said operative position.

3. The improvement as defined in claim 2 wherein said mounting means includes an apertured wall operatively fixed with respect to said housing in rearwardly spaced relation with respect to said drive track, and an actuating member fixed to said anvil extending rearwardly through said apertured wall.

4. The improvement as defined in claim 3 wherein said spring means comprises a compression coil spring surrounding said actuating member having one end operatively connected with said anvil and an opposite end operatively connected with said apertured wall.

5. The improvement as defined in claim 4 wherein said manually operable means comprises a lever pivoted to a portion of said actuating member extending rearwardly of said apertured wall for movement between inoperative and operative positions, said lever having forwardly facing cam surface means operatively engaged with said apertured wall so as to (1) enable said compression coil spring to resiliently bias said anvil, said feeder and the spring associated therewith into said operative position when said lever is in said inoperative position and (2) enable said lever to move said anvil, said feeder and the spring associated therewith into said staple clearing position against the bias of said compression coil spring in response to the movement of said lever from its inoperative to its operative position.

6. The improvement as defined in claim 5 wherein said cam surface means includes two straight surfaces disposed at right angles with respect to one another and curved surfaces joining the straight surfaces, said two straight surfaces being spaced perpendicularly from the pivotal axis of said lever different distance.

* * * * *